United States Patent [19]

Yamaguchi et al.

[11] Patent Number: 4,935,299

[45] Date of Patent: Jun. 19, 1990

[54] TRANSFER MEDIUM

[75] Inventors: Yoshitaka Yamaguchi; Hitoshi Fukushima; Kohei Iwamoto; Katsumori Takei, all of Suwa, Japan

[73] Assignee: Seiko Epson Corporation, Tokyo, Japan

[21] Appl. No.: 143,555

[22] PCT Filed: Apr. 17, 1987

[86] PCT No.: PCT/JP87/00248

§ 371 Date: Dec. 16, 1987

§ 102(e) Date: Dec. 16, 1987

[87] PCT Pub. No.: WO87/06196

PCT Pub. Date: Oct. 22, 1987

[30] Foreign Application Priority Data

Apr. 17, 1987 [JP] Japan ..... 61-088751

[51] Int. Cl.[5] ..... B41M 5/20

[52] U.S. Cl. ..... 428/323; 427/47; 427/128; 428/195; 428/206; 428/329; 428/484; 428/488.1; 428/692; 428/900; 428/913; 428/914

[58] Field of Search ..... 428/206, 207, 212, 216, 428/329, 692, 484, 488.1, 488.4, 913, 914, 900, 195, 323; 427/47, 128

[56] References Cited

FOREIGN PATENT DOCUMENTS 59-224390 12/1984 Japan .
59-224393 12/1984 Japan .
60-247593 12/1985 Japan .
61-63494 4/1986 Japan .

*Primary Examiner*—Pamela R. Schwartz

[57] ABSTRACT

A transfer medium for use in a printing apparatus wherein a magnetic ink layer containing magnetic particles is heat-melted and transferred to a material to be printed. The magnetic ink layer (12) contains magnetic particles (121) and (122) different from each other in size, which enables printing to be conducted with excellent quality.

3 Claims, 1 Drawing Sheet

TRANSFER MEDIUM

TECHNICAL FIELD

The present invention relates to an ink medium for use in a printing method forming visible images by employing magnetic attraction force generating means.

TECHNICAL BACKGROUND

Up to now, a printing method utilizing magnetic ink medium has been suggested as a small-sized and low cost non-impact type printing method. For example, Japanese Patent Laid-Open No. 96541/77 describes a thermal transfer method wherein a magnetic attraction force acts on ink on a transfer medium corresponding to heat image by a magnetic means which is provided apart from a heat supply means. One of the ink media utilized in such method is described in Japanese Patent Laid-Open No. 36596/84.

However, when the transfer meidum described in Japanese Patent Laid-Open No. 36596/84 is employed for the printing method described in Japanese Patent Laid-Open No. 96541/77, ink is not transferred onto transfer paper sufficiently when magnetic force acts on the transfer medium to achieve transfer. This results in printing a broken line when a solid line is required, and normal letter form is not achieved when literal form is required.

This method is particularly disadvantageous and results in poor transfer which becomes more noticable when transfer paper having inferior surface smoothness is utilized.

Therefore, in order to solve the above disadvantages, the object of the present invention is to achieve high quality letter and image printing even on the transferred medium having inferior surface smoothness and to display completely the advantages of printing apparatus utilizing magnetic ink medium which conducts printing utilizing magnetic force.

SUMMARY OF THE INVENTION

The transfer medium of the present invention includes a magnetic ink layer 12 containing two types of magnetic particles different from each other in size, 21 and 22, formed on a support member 11 as shown in FIG. 1.

The magnetic ink layer is a thermoplastic material (generally, organic material) containing magnetic particles.

Substances having ferromagnetic properties, magnetic fine particles of metal or alloy such as $\gamma$-$Fe_2O_3$, $FeO$-$Fe_2O_3$, Mn-Zn-$Fe_2O_3$, Ni-Zn-$Fe_2O_3$, are used as the magnetic fine particles. Such magnetic fine particles are in pulverized form under normal conditions.

Further, it is desirable to include two kinds of magnetic particles, one having a small particle size diameter of 0.01 to 1 $\mu$m and the other a large particle size greater than 1 to 50 $\mu$m, in the magnetic ink layer. The mixing ratio of these particles is from 1:15 to 5:1.

Furthermore, the large particle size magnetic particles can be linearly shape. In this case, preferable ratio of the major axis to the minor axis is from 3:1 to 20:1.

In addition, the ratio of magnetic particles contained in the magnetic ink layer is preferably from 5 to 70 wt% of the whole weight of the ink layer.

Such a transfer medium can be utilized not only for a printing apparatus wherein a transfer medium contacts a transferred medium at the printing portion at which transferring is carried out by fusing a magnetic ink layer and applying a magnetic field, but also in an apparatus wherein the transfer medium does not contact the transferred medium for printing.

Therefore, extremely high quality transferring can be carried out by mixing two types of magnetic particles having different particle size in the magnetic ink layer.

The reason is that although magnetic particles have larger magnetic force in proportion to the diameter thereof and have very strong attraction force in the magnetic field, when only large-sized magnetic particles are contained in the magnetic ink layer, only magnetic particles move and aggregate when the magnetic ink layer fuses and is transferred onto the transferred medium by the magnetic field. Thus, the thermoplastic resin layer in the magnetic ink layer is not transferred. As a result, only extremely small-sized dots can be formed and characters, pictures and the like can not be formed with continuous lines.

On the contrary, when only small-sized magnetic particles are included in the magnetic ink layer, although extremely small-sized magnetic particles are dispersed uniformly in the thermoplastic resin forming magnetic ink layer, namely such particles are superior in dispersion properties, inferior transferring occurs in the magnetic field due to the weakness of the magnetic force.

Therefore, when large-sized magnetic particles and small-sized magnetic particles are mixed, the latter follows the former as a core and both of them are transferred onto the transferred medium by the magnetic force in the magnetic field, resulting in improved transferring. In addition, since a sufficient amount of magnetic ink can be transferred, continuous lines consisting of letters or images can be achieved, resulting in printing of high transfer efficiency.

For a foundation to which the magnetic ink layer is attached, a material with high heat-resistance and high mechanical strength to some degree is desirable.

For example, a 1 to 30 $\mu$m thick or more desirably, 2 to 5 $\mu$m thick resin film, such as polyethylene, polypropylene, polyester, polyimide, polyethersulfone and polyethylene terephthalate, can be employed.

As thermoplastic resin containing magnetic particles, an organic material selecting from the group consisting of paraffin wax, microcrystalline wax, carnauba wax, oxide wax, candelilla wax, montan wax, Ficher-Tropch-Wax, $\alpha$-olefin/maleic anhydride copolymer, aliphatic amide, aliphatic ester, distearyl ketone, ethylene-vinyl acetate copolymer, ethylene-ethyl acrylate copolymer, epoxy resin and vinyl-butyral or the mixture thereof are suitable.

In general, the transfer medium includes a magnetic ink layer adhered onto a supporting member. In the case of that the ink layer is formed by laminating on a sheet-type supporting member, a thermoplastic resin mixed with magnetic fine particles uniformly is coated on the supporting member (namely, referred to as hot-melt method). Alternatively after the dispersing density of thermoplastic resin mixed with magnetic fine particles is reduced with an organic solvent and is coated on the supporting member, such organic solvent is vaporized (namely, referred to as solvent method).

Further, it may be desirable to add a very small amount of dispersant to the magnetic ink layer in order to disperse the magnetic fine particles more uniformly.

In this case, the amount of dispersant is 0.1 to 2 wt% of the whole weight of magnetic ink.

The dispersant is, for example, polyoxylene-nonyl-phenyl-ether, naphthaline-sulfonic-acid-formaldehyde, di-octyl succinate-sulfonic acid sodium salt, surface-active-agent of polymer type like polycarboxylic acid, polyoxyethylene arkyl ether, polyoxypropylene, polyoxyethylene-brock-polymer, ester made from sorbitol and aliphatic acid, and ester made from aliphatic acid and plyoxyethylene glycol.

Furhermore, it is proper to color the ink by including dye, pigment and the like in the thermoplastic resin. For example, azo-series, anthraquinone-series, naphthoquinone-series, quinone-series, indigo-series, perylene-series, triphenylmethyl-series acridine-series, diazo-series dyes are suitable for such dye, and phthalocyanine blue, benzine yellow, carmine 6B and like are suitable for such pigment. When these coloring materials, such as dye and pigment, are included in the thermoplastic resin, dots of various colors can be transferred by magnetic ink layer which is colored to be black, red, blue and the like.

In addition, it is also possible to print with the color which is the color of the magnetic fine particles itself or which has already been obtained by the magnetic fine particles previously colored by paint, dye, plating and the like, not adding colorant such as dye and pigment to the thermoplastic resin layer.

BRIEF DESCRIPTION OF THE DRAWINGS

Still other objects and advantages of the invention will in part be obvious and will in part be apparent from the specification.

BEST MODE FOR CARRYING OUT THE INVENTION

Examples

Figure 1:
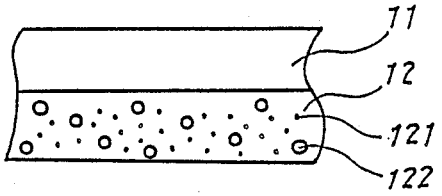
FIG. 1 is an explanatory view showing a magnetic ink medium of the present invention.
Figure 2:
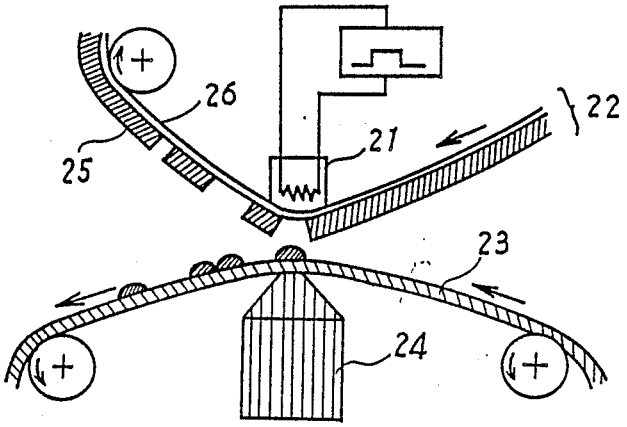
FIG. 2 is an explanatory view showing the condition in which the magnetic ink medium of the present invention is employed in a non-impact type printing apparatus for printing.

As shown in FIG. 1, a transfer medium including a foundation 11 and a magnetic ink layer 12 was made. A thermal head as a thermal energy generating means and a permanent magnet as a magnetic attraction force geneating means were employed. Further, although there were two types of printing methods, such as impact type and non-impact type, non-impact type printing method was employed in the example. The example of non-impact type is described hereinafter. A thermal head 21, a transfer medium 22 transferred paper 23 a magnet 26 are provided in order as shown in FIG. 2. A magnetic ink layer 25 of transfer medium 22 did not contact paper 23 (at just under the head) while heat was applied from the surface of a foundation 26 by thermal and head 21, thus the melted ink was transferred onto transferred paper 23 due to the magnetic attraction force.

Transfer medium 22 was formed by coating 6 μm thick of magnetic ink 25 having the following composition on 4 μm thick PET (Polyethylene terephthalate) film as a foundation 26 which has higher-temperature capability than usual by orientation of melted PET in two directions.

The components of magnetic ink layer 25 was as follows.

| | | |
|---|---|---|
| 1. Magnetic particle ($FeO—Fe_2O_3$) | | |
| size of particle | ... 0.08 μm | 20 wt % |
| (diameter) | 0.5 μm | 20 wt % |
| 2. Carnauba wax | | 20 wt % |
| 3. Paraffin wax | | 30 wt % |
| 4. Ethylene vinyl acetate (EVA) | | 5 wt % |
| 5. Dispersant (polyoxylene nonyl phenyl ether) | | 1 wt % |
| 6. Dye (anthraquinone carbazole: black) | | 4 wt % |

In summary spherical magnetic particles made of $FeO-Fe_2O_3$ having a diameter of 0.08 μm and that having a diameter of 0.5 μm were dispersed in thermoplastic resin made of organic resin mixed with carnauba wax, paraffin wax and EVA. In addition, a very small amount of dispersant was mixed therein so as that carnauba wax, paraffin wax and EVA were to be dispersed and mixed well. Further, some dye was contained therein.

The melting point of such magnetic ink was 70° C.±5° C., and as shown in the apparatus of FIG. 2, thermal head generated heat to melt magnetic ink layer 25 of magnetic ink medium 22 which disposed to be facing to magnet 24 which is a magnetic force generating means of magnetic ink medium. Thus magnetic ink mediun 22 and transferred paper 23 travelled between magnet 24 and thermal head 21.

In this case, thermal head 21 generated heat in accordance with a printing instruction signal which conducted printing of characters and images, so as to melt the magnetic ink layer in the predetermined position and the melted ink portion was transferred onto the transferred paper 23 by magnetic 24, attraction force of magnet.

In use of the magnetic ink medium, the transfer efficiency was superior even on a transferred paper having rough surface smoothness, and clear printing could be achieved without interruption of characters or lines when such should be continuous.

When transfer was carried out utilizing various kinds of transfer papers having inferior surface smoothness, the transfer efficiency was superior sufficiently.

The magnetic ink was estimated based on the transfer efficiency and the rate of dot reproducibility.

The transfer efficiency was expressed as the transfer area per a dot which was actually transferred onto the transferred medium as compared to the heat generating area per a dot formed on the thermal head. It was expressed by the formula:

Transfer Efficiency (%)=Transfer Area Per Dot Transferred onto Transferred Medium/Heat Generating Area for A×100 Dot of Thermal Head.

The dot reproducibility was expressed as the rate of the number of dots which were actually transferred onto the transferred medium as compared to the number of dots which were heated on the thermal head for forming characters and the like, in the case of forming characters and graphic images on the transferred medium with a plurality of dots. It was expressed by the formula:

Dot reproducibility (%)=(number of transferred dots/number of heated dots)×100

Papers having inferior surface smoothness, such as 3, 10 and 30 seconds, were utilized as a transferred medium. In general, paper having superior surface smoothness is about 100 seconds and thus, the paper having 3 seconds surface smoothness belongs to the paper of inferior smoothness.

The estimation of printing quality was expressed as the sum of transfer efficiency and dot reproducibility utilizing a transferred medium with surface smoothness of 3 seconds.

The estimation of of printing quality of 85 to 100% is extremely superior in printing quality ( ◎ ), 75 to less than 85% is superior in printing quality (○) and 50 to less than 75% is inferior in printing quality (Δ) and 0 to less than 50% is useless for printing (×).

The estimation of transferred printing quality of medium of Example 1 was ◎ . (See Table 1)

Example 2

The transfer medium was formed by the same apparatus of Example 1 and the same magnetic ink medium, except for the following components of the magnetic ink layer.

| | | |
|---|---|---|
| 1. Magnetic particle ($Ni—Zn—Fe_2O_3$) | | |
| size of | ... 0.05 μm | 15 wt % |
| particle | 0.4 μm | 25 wt % |
| 2. Microcrystalline wax | | 40 wt % |
| 3. Carnauba wax | | 10 wt % |
| 4. EVA | | 5 wt % |
| 5. Dispersant (same as Example 1) | | 1 wt % |
| 6. Dyes (same as Example 1) | | 4 wt % |

The melting point of this magnetic ink was 65° C.±5° C.

This transfer medium was also superior in both transfer efficiency and dot reproducibility, and the total estimation was ◎ . (See Table 1)

Similarly, the same magnetic ink medium except for the components of the magnetic ink layer was formed and the test was conducted thereon with the same printing apparatus. The components of the magnetic ink layer is described hereunder.

Example 3

Components of the magnetic ink layer

| | | |
|---|---|---|
| 1. Magnetic particle | | |
| size of | ... 0.05 μm | 15 wt % |
| particle | | |
| ($Ni—Zn—Fe_2O_3$) | | |
| | 0.6 μm | 15 wt % |
| ($FeO—Fe_2O_3$) | | |
| 2. Paraffin wax | | 50 wt % |
| 3. α-olefin/anhydride copolymer | | 10 wt % |
| 4. EEA (Ethylene-ethyl acrylate) | | 5 wt % |
| 5. Dispersant (same as Example 1) | | 1 wt % |
| 6. Dyes (same as Example 1) | | 4 wt % |

The melting point of the magnetic ink layer was 65° C.±5° C.

Example 4

Components of the magnetic ink layer

| | | |
|---|---|---|
| 1. Magnetic particle ($FeO—Fe_2O_3$) | | |
| Diameter | ... 0.02 μm | 10 wt % |
| | 0.01 μm | 20 wt % |

-continued

| | | |
|---|---|---|
| | 0.7 μm | 10 wt % |
| 2. Paraffin wax | | 40 wt % |
| 3. Carnauba wax | | 10 wt % |
| 4. EVA | | 5 wt % |
| 5. Dispersant (same as Example 1) | | 1 wt % |
| 6. Dyes (same as Example 1) | | 4 wt % |

The melting point of the magnetic ink layer was 70° C.±5° C. The total estimations of printing quality of transfer mediums shown in Examples 3 and 4 were ◎ . Further, three kinds of magnetic particles different from each other in diameter were employed in Example 4.

The estimation of printing quality of the transfer media of Examples 3 and 4 were conducted in the same manner are shown in Table 1. The Examples are described in accordance with Table 1. Examples and Comparative Examples shown in Table 1 indicate the results of tests employing the same printing apparatus of Example 1. Further, the dispersant and dyes shown in Table 1 were same as those of Example 1.

In Example 5, the mixing ratio of magnetic grain was 5 wt% on the basis of the magnetic ink layer, and the sum of transfer efficiency and dots reproducibility was slightly inferior ( ○).

In Example 6, the mixing ratio of magnetic grain was 3 wt%, and the estimation of printing was more inferior (Δ).

Example 7 is an example showing an increase in the amount of magnetic particles to 70 wt%. The total estimation of printing quality was superior (○).

Example 8 is an example to increase the amount to 85 wt%. The total estimation was inferior (Δ).

Therefore, it was noted that 5 to 70 wt% of the magnetic particles was desirable.

In Example 9, 2 wt% of large magnetic particles and 28 wt% of small magnetic particles were mixed. Namely, the mixing ratio was 1:14 (approximately 1:15). The total estimation of printing quality was superior (○).

In Example 10, the mixing ratio was 1:25 (1 wt%:25 wt%) and the estimation of printing was inferior (Δ).

Further, as shown in Example 11, when the mixing ratio of large matnetic particles was larger than that of small magnetic particles, 5:1 (25 wt%:5 wt%), the estimation of printing quality was superior (○).

Accordingly, 1:15 to 5:1 mixing ratio of large magnetic particles to small magnetic particles is suitable.

In Example 12, the diameter of large magnetic particles was 50 μm and the total estimation of printing quality was superior (○).

In Example 13, the diameter of small magnetic grain was minimized to be 0.01 μm and the total estimation of printing was superior ( ○).

Then, when the diameter of large magnetic grain was maximized to be 100 μm such as in Example 14, the total estimation of printing was inferior (Δ).

Therefore, the diameter of large magnetic particles of above about 1 to 50 μm and that of small magnetic particles of about 0.01 to 1.0 μm are suitable.

In the next series of Examples linear magnetic particles were utilized as large magnetic particles in Examples 15 to 20.

In Examples 15 to 18, cylindrical magnetic particles having a minor axis of 0.1μ and a major axis of 1 μm were utilized.

Example 18

A test of printing was conducted with the same printing apparatus of Example 1.

The components of magnetic ink layer was as follows.

In the printing with such magnetic ink medium, transfer efficiency and dot reproducibility were excellent and the total estimation of printing quality was extremely superior ( ◎ ).

In Example 16, the whole mixing ratio of magnetic particles was same as Example 15, and the mixing ratio of large (long) magnetic particles to spherical small magnetic particles was changed. The estimation of printing was extremely superior ( ◎ ).

In Examples 17 and 18, the mixing ratio of magnetic particles was increased and the mixing ratio of large (long) magnetic particles to small magnetic particles was changed, resulting in the total estimation of printing quality of extremely superior ( ◎ ).

In in Example 19, the ratio of the major axis of cylindrical magnetic particles to the mirror axis was reduced to 3:1, and the total estimation of printing quality deteriorated a little, to superior ( ○ ).

Further, when the ratio of major axis to minor axis was increased to be 20:1 such as in Example 20, the total estimation also deteriorated a little, to superior ( ○ ).

Therefore, when linear magnetic particles are utilized as large magnetic particles the suitable ratio of the major axis to the minor axis is within the range between 3:1 and 20:1.

As shown in Examples 21 to 24, when the magnetic ink layer of a thickness of 3 to 15μ and the foundation with a thickness of 2 to 15μ were utilized as the transfer medium of Example 1, excellent printing could be carried out as extremely superior ( ◎ ).

The following comparative tests were conducted to make sure of the effects of the invention. In Comparative tests 1 and 2 which correspond to Example 1, it was noted that both the transfer efficiency and dot reproducibility were much deteriorated (×) by utilizing only one size of magnetic particles.

Further, Comparative tests 3 to 6 show the results of utilizing cylindrical magnetic particles as large magnetic particles only cylindrical magnetic particles, and only magnetic particles with small diameter. The estimation of printing quality was inferior (×) in either case.

In each example and Comparative Example shown in Table 1, the same dyes and dispersant of Example 1 were utilized. In Table 1, "$\phi$=x" means that the diameter of nearly spherical magnetic particles is x.

Further, in Example 1, when large and small cubic magnetic particles in which the longest distance between sides was to be the same as the diameter of magnetic particle shown in Table 1 were utilized instead of spherical ones, both the transfer efficiency and dot reproducibility were same as those in Example 1.

Furthermore, when large and small ragular tetrahedrons in which the longest distance was to be the same as the diameter were utilized, the result was same as that of Example 1.

When phthalocyanine blue and benzidine yellow were utilized instead of above dyes, the result was same as that of Example 1.

In Examples 1, 2, 19 and 20, when a compound of condensation between naphthalene sulfonic acid and formaldehdye and dioctyl succinate-sulfonic acid sodium salt were utilized as dispersant instead of polyoxylene-nonyl-phenyl-ether, the result was same as shown in Table 1.

Further, when the amount of dyes was substituted for microcrystalline wax in Example 2, the result was the same as Example 2.

In Examples 15 and 17, when the transfer medium included magnetic ink without dyes, the same transfer efficiency and dot reproducibility as in Examples 15 and 17 could be obtained. In these cases, the color of the transferred dots was mainly the color of the magnetic grain itself (black).

When a test was conducted with the transfer medium of the magnetic ink without dyes in the other Examples and Comparative examples of Table 1 (other conditions were the same), the same transfer efficiency and dot reproducibility could be obtained. The color of the transferred dots was that of the magnetic particles itself (black).

Further, in Examples 1, 2, 15 and 16, when the transfer medium was disposed to be in contact with the transferred medium, the transfer efficiency and dot reproducibility were deteriorated by 2% as compared with each result, however an excellent printing could be carried out.

| | Transfer Medium | | | |
|---|---|---|---|---|
| | Magnetic Ink Layer | | | |
| | Magnetic Particles | Components of Magnetic Particles | Thermoplastic Resin | Thickness |
| Example | | | | |
| 1 | $FeO—Fe_2O_3$<br>40 wt % | Φ = 0.5 μm (20 wt %)<br>Φ = 0.08 μm (20 wt %)<br>Total 40 wt % | Carnauba Wax (20 wt %)<br>Paraffin Wax (20 wt %)<br>EVA (5 wt %) Dispersant (1 wt %)<br>Dye (4 wt %) Total 60 wt % | 6 μm |
| 2 | $Ni—Zn—Fe_2O_3$<br>40 wt % | Φ = 0.4 μm (25 wt %)<br>Φ = 0.05 μm (15 wt %)<br>Total 40 wt % | Microcrystalline Wax (40 wt %)<br>Carnauba Wax (10 wt %)<br>Disper- (1 wt %), EVA (5 wt %)<br>sant (4 wt %) Total 60 wt %<br>Dye | The same as the above |
| 3 | $Ni—Zn—Fe_2O_2$<br>$FeO—Fe_2O_3$<br>each 15 wt %<br>Total 30 wt % | Φ = 0.6 μm (15 wt %)<br>Φ = 0.05 μm (15 wt %)<br>Total 30 wt % | Paraffin Wax (50 wt %)<br>α-olefin/anhydride Copolymer<br>(10 wt %)<br>EEA (5 wt %) Dispersant (1 wt %)<br>Dye (4 wt %) Total 70 wt % | The same as the above |
| 4 | $FeO—Fe_2O_3$<br>40 wt % | Φ = 0.7 μm (10 wt %)<br>Φ = 0.02 μm (10 wt %)<br>Φ = 0.01 μm (20 wt %) | Paraffin Wax (40 wt %)<br>Carnauba Wax (10 wt %)<br>EVA (5 wt %) Dispersant (1 wt %) | The same as the |

-continued

| | | | | |
|---|---|---|---|---|
| | | Total 40 wt % | Dye (4 wt %) Total 60 wt % | above |
| 5 | The same as the above 5 wt % | Φ = 0.5 μm (2.5 wt %)<br>Φ = 0.08 μm (2.5 wt %)<br>Total 5 wt % | Carnauba Wax (25 wt %)<br>Paraffin Wax (60 wt %)<br>EVA (5 wt %) Dispersant (1 wt %)<br>Dye (4 wt %) Total 95 wt % | The same as the above |
| 6 | The same as the above 3 wt % | Φ = 0.5 μm (2.5 wt %)<br>Φ = 0.08 μm (0.5 wt %)<br>Total 3 wt % | Carnauba Wax (25 wt %)<br>Paraffin Wax (62 wt %)<br>EVA (5 wt %) Dispersant (1 wt %)<br>Dye (4 wt %) Total 97 wt % | The same as the above |
| 7 | The same as the above 70 wt % | Φ = 0.5 μm (35 wt %)<br>Φ = 0.08 μm (35 wt %)<br>Total 70 wt % | Carnauba Wax (10 wt %)<br>Paraffin Wax (10 wt %)<br>EVA (5 wt %) Dispersant (1 wt %)<br>Dye (4 wt %) Total 30 wt % | The same as the above |
| 8 | The same as the above 85 wt % | Φ = 0.5 μm (40 wt %)<br>Φ = 0.08 μm (45 wt %)<br>Total 85 wt % | Carbnauba Wax (2.5 wt %)<br>Paraffin Wax (2.5 wt %)<br>EVA (5 wt %) Dispersant (1 wt %)<br>Dye (4 wt %) Total 15 wt % | The same as the above |
| 9 | $FeO—Fe_2O_3$ 30 wt % | Φ = 0.5 μm (2 wt %)<br>Φ = 0.08 μm (28 wt %)<br>Total 30 wt % | Carnauba Wax (30 wt %)<br>Paraffin Wax (30 wt %)<br>EVA (5 wt %) Dispersant (1 wt %)<br>Dye (4 wt %) Total 70 wt % | 6 μm |
| 10 | The same as the above 30 wt % | Φ = 0.5 μm (1 wt %)<br>Φ = 0.08 μm (29 wt %)<br>Total 30 wt % | Total<br>The same as the above 70 wt % | The same as the above |
| 11 | The same as the above 30 wt % | Φ = 0.05 μm (25 wt %)<br>Φ = 0.08 μm (5 wt %)<br>30 wt % | The same as the above<br>Total 70 wt % | The same as the above |
| 12 | The same as the above 30 wt % | Φ = 50 μm (15 wt %)<br>Φ = 1 μm (15 wt %)<br>Total 30 wt % | The same as the above<br>Total 70 wt % | The same as the above |
| 13 | The same as the above 30 wt % | Φ = 0.1 μm (15 wt %)<br>Φ = 0.01 μm (15 wt %)<br>Total 30 wt % | The same as the above<br>Total 70 wt % | The same as the above |
| 14 | The same as the above | Φ = 100 μm (15 wt %)<br>Φ = 1 μm (15 wt %)<br>Total 30 wt % | Carnauba Wax (30 wt %)<br>Paraffin Wax (30 wt %)<br>EVA (5 wt %) Dispersant (1 wt %)<br>Dye (4 wt %) Total 70 wt % | The same as the above |
| 15 | The same as the above 30 wt % | 0.1 μΦ × 1 μ(25 wt %)<br>Φ = 0.5 μ (5 wt %)<br>Total 30 wt % | Microcrystalline Wax (34 wt %)<br>Carnauba Wax (24 wt %)<br>Ethylene/vinyl acetate copoly-(8 wt %)<br>mer<br>Disper-(0.1 wt %)<br>sant<br>Dye (3.9 wt %) Total 70 wt % | 10 μm |
| 16 | The same as above 30 wt % | 0.1 μ Φ × 1 μ (15 wt %)<br>Φ = 0.5 μ (15 wt %)<br>Total 30 wt % | Total<br>The same as the above 70 wt % | The same as the above |
| 17 | $FeO—Fe_2O_3$ 60 wt %<br>Total 60 wt % | 0.1 μ Φ × 1 μ (5 wt %)<br>Φ = 0.5 μ (55 wt %)<br>Ethylene/vinyl acetate copolymer (6 wt %)<br>Dye (3.9 wt %) Dispersant (0.1 wt %)<br>Total 40 wt % | Paraffin Wax (20 wt %)<br>Carnauba Wax (10 wt %) | 10 μm |
| 18 | The same as the above 60 wt %<br>Total 60 wt % | 0.1 μ Φ × 1 μ (10 wt %)<br>Φ = 0.5 μ (50 wt %) | The same as the above<br>Total 40 wt % | The same as the above |
| 19 | The same as the above 30 wt %<br>Total 30 wt % | 1 μ Φ × 3 μ (25 wt %)<br>Φ = 0.5 μ (5 wt %) | The same as Example 15<br>Total 70 wt % | The same as the above |
| 20 | The same as the above 30 wt %<br>Total 30 wt % | 1 μ Φ 20 μ (25 wt %)<br>Φ = 0.5 μ (5 wt %) | The same as the above<br>Total 70 wt % | The same as the above |
| 21 | The same as Example 1 | The same as Example 1<br>Total 40 wt % | The same as Example 1<br>Total 60 wt % | 3 μm |
| 22 | The same as the above<br>Total 40 wt % | The same as the above<br>Total 60 wt % | The same as the above | 15 μm |
| 23 | The same as the above | The same as the above<br>Total 40 wt % | The same as the above<br>Total 60 wt % | 6 μm |
| 24 | The same as the above<br>Total 40 wt % | The same as the above<br>Total 60 wt % | The same as the | above |
| Comparative Example | | | | |
| 1 | $FeO—Fe_2O_3$ 40 wt % | Φ = 0.08 μm only | Paraffin Wax (40 wt %)<br>Carnauba Wax (10 wt %)<br>EVA (5 wt %) Dispersant (1 wt %)<br>Dye (4 wt %) Total 60 wt % | 6 μm |
| 2 | The same as the above 40 wt % | Φ = 0.5 μm only | The same as the above<br>Total 60 wt % | The same as the above |
| 3 | The same as the above | Only spherical ones (Φ = 0.5 μm) | Microcrystalline Wax (40 wt %)<br>Carnuba Wax (24 wt %) | 10 μm |

-continued

| | | | | |
|---|---|---|---|---|
| | 24 wt % | | Disper- (0.1 wt %), EVA (8 wt %) sant Dye (3.9 wt %) Total 76 wt % | |
| 4 | The same as the above 24 wt % | Only cylindrical ones (2 μm × 0.2 μm) | The same as the above Total 76 wt % | The same as the above |
| 5 | The same as the above 60 wt % | Only spherical ones (Φ = 0.2 μm) Dye (3.9 wt %) Total 40 wt % | Paraffin Wax (20 wt %) Carnauba Wax (10 wt %) EVA (6 wt %) Dispersant (0.1 wt %) | The same as the above |
| 6 | The same as the above 60 wt % | Only cylindrical ones (1 μm × 0.1 μm) | The same as the above Total 40 wt % | The same as the above |

| | Foundation | | Transfer Efficiency (%) | | | Dot Reproducibility (%) | | | |
|---|---|---|---|---|---|---|---|---|---|
| | | | Smoothness of Transferred Medium (seconds) | | | | | | |
| Example | Kind of Foundation | Thickness | 3 | 10 | 30 | 3 | 10 | 30 | Totals Estimation |
| 1 | Polyethylene terephthalate | 4 μm | 88 | 90 | 96 | 100 | 100 | 100 | ◎ |
| 2 | The same as the above | The same as the above | 90 | 95 | 98 | 100 | 100 | 100 | ◎ |
| 3 | The same as the above | The same as the above | 87 | 90 | 94 | 100 | 100 | 100 | ◎ |
| 4 | The same as the above | The same as the above | 94 | 98 | 98 | 100 | 100 | 100 | ◎ |
| 5 | The same as the above | The same as the above | 75 | 78 | 82 | 88 | 86 | 89 | ○ |
| 6 | The same as the above | The same as the above | 71 | 74 | 77 | 81 | 83 | 85 | Δ |
| 7 | The same as the above | The same as the above | 75 | 78 | 79 | 79 | 83 | 84 | ○ |
| 8 | The same as the above | The same as the above | 62 | 66 | 72 | 76 | 81 | 84 | Δ |
| 9 | Polyethylene tetrepthlate | 4 μm | 84 | 88 | 92 | 100 | 100 | 100 | ○ |
| 10 | The same as the above | The same as the above | 74 | 80 | 89 | 95 | 100 | 100 | Δ |
| 11 | The same as the above | The same as the above | 81 | 84 | 88 | 100 | 100 | 100 | ○ |
| 12 | The same as the above | The same as the above | 75 | 77 | 79 | 80 | 82 | 85 | ○ |
| 13 | The same as the above | The same as the above | 75 | 77 | 82 | 84 | 83 | 86 | ○ |
| 14 | The same as the above | The same as the above | 66 | 69 | 72 | 76 | 77 | 80 | Δ |
| 15 | The same as the above | The same as the above | 91 | 94 | 96 | 100 | 100 | 100 | ◎ |
| 16 | The same as the above | The same as the above | 90 | 93 | 95 | 100 | 100 | 100 | ◎ |
| 17 | Polyethylene | 4 μm | 86 | 91 | 94 | 100 | 100 | 100 | ◎ |

-continued

| | | | | | | | | | |
|---|---|---|---|---|---|---|---|---|---|
| | terephthalate | | | | | | | | |
| 18 | The same as the above | The same as the above | 91 | 94 | 96 | 100 | 100 | 100 | ◎ |
| 19 | The same as the above | The same as the above | 75 | 78 | 82 | 82 | 86 | 86 | ○ |
| 20 | The same as the above | The same as the above | 76 | 79 | 86 | 79 | 82 | | ○ |
| 21 | The same as the above | 4 μm | 88 | 94 | 96 | 100 | 100 | 100 | ◎ |
| 22 | The same as the above | The same as the above | 91 | 93 | 97 | 100 | 100 | 100 | ◎ |
| 23 | The same as the above | 2 μm | 89 | 92 | 94 | 100 | 100 | 100 | ◎ |
| 24 | The same as the above | 15 μm | 92 | 95 | 98 | 100 | 100 | 100 | ◎ |
| Comparative Example | | | | | | | | | |
| 1 | The Same as Example 1 | The same as the left | 19 | 20 | 22 | 24 | 30 | 34 | X |
| 2 | The same as the above | The same as the left | 40 | 45 | 47 | 71 | 75 | 79 | X |
| 3 | The Same as Example 15 | The same as the left | 23 | 29 | 34 | 61 | 64 | 63 | X |
| 4 | The same as the above | The same as the left | 33 | 36 | 39 | 66 | 67 | 69 | X |
| 5 | The Same as Example 17 | The same as the left | 42 | 44 | 46 | 71 | 70 | 73 | X |
| 6 | The same as the above | The same as the left | 39 | 42 | 46 | 61 | 63 | 65 | X |

What is claimed is:

1. A transfer medium comprising:

a foundation;

a thermoplastic magnetic ink layer having magnetic ink particles disbursed therein on said foundation and a portion of the ink layer and magnetic particles therein are adapted to be transferred on to a receiving medium in response to magnetic force applied to the receiving medium;

said thermoplastic magnetic ink layer including two or more kinds of magnetic particles different from each other in size, wherein the magnetic particles of the first size have a small particle size with a diameter of from about 0.01 to 1 μm and the magnetic particles of a second size have a large particle size with a major axis or diameter of from about 0.1 to 50 μm;

the weight ratio of large magnetic particles to small magnetic particles between 1:15 to 5:1; and the magnetic particles are present in an amount between 5 to 70 weight percent of the ink layer.

2. The transfer medium as claimed in claim 1, wherein the particles having a large particle size are linear shape.

3. The transfer medium as claimed in claim 2, wherein the ratio of major axis of the linear magnetic particles to minor axis is 3:1 to 20:1.

* * * * *

UNITED STATES PATENT AND TRADEMARK OFFICE

CERTIFICATE OF CORRECTION

PATENT NO. : 4,935,299

DATED : June 19, 1990

INVENTOR(S) : Yoshitaka Yamaguchi, et al.

It is certified that error appears in the above-identified patent and that said Letters Patent is hereby corrected as shown below:

At column 13, line 44 (claim 1, line 4) delete the word "disbursed" and insert --dispersed--;

at column 13, line 46 (claim 1, line 6) delete the words "on to" and insert --onto--.

Signed and Sealed this

Twenty-fourth Day of November, 1992

*Attest:*

DOUGLAS B. COMER

*Attesting Officer*

*Acting Commissioner of Patents and Trademarks*